US006553193B1

(12) United States Patent
Takara

(10) Patent No.: US 6,553,193 B1
(45) Date of Patent: Apr. 22, 2003

(54) IMAGE FORMING APPARATUS AND IMAGE FORMING METHOD WITH PUNCHING MODE

(75) Inventor: Syusaku Takara, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/081,209

(22) Filed: Feb. 25, 2002

(51) Int. Cl.[7] ..... G03G 15/00
(52) U.S. Cl. ..... 399/82; 399/407
(58) Field of Search ..... 399/82, 83, 85, 399/407, 45, 389

(56) References Cited

U.S. PATENT DOCUMENTS 5,282,001 A * 1/1994 Watson ..... 399/389
5,722,029 A * 2/1998 Tomidokoro et al. ..... 399/389
6,325,585 B1 * 12/2001 Sasaki et al. ..... 399/407
6,337,970 B1 1/2002 Okamoto et al. ..... 399/407

FOREIGN PATENT DOCUMENTS

JP 11-255418 A 9/1999

* cited by examiner

*Primary Examiner*—Joan Pendegrass
(74) *Attorney, Agent, or Firm*—Foley & Lardner

(57) ABSTRACT

When printing on a tab sheet has been started, a main CPU confirms with a first priority whether the presence of a punching process for the tab sheet was set immediately before the start of printing, confirms with a second priority whether the presence/absence of a punching process associated with a sheet feed cassette that feeds the tab sheet was set, and confirms with a third priority whether the presence of a tab sheet punching process was set in initial system operation settings, thus controlling the punching process for the tab sheet.

9 Claims, 4 Drawing Sheets

IMAGE FORMING APPARATUS AND IMAGE FORMING METHOD WITH PUNCHING MODE

BACKGROUND OF THE INVENTION

The present invention relates to an image forming apparatus, such as a copying machine, and an image forming method for reading an image on an original and forming an image.

In a conventional image forming apparatus such as a copying machine, when a punching process is to be performed at the time of printing, the punching process is performed on the basis of initial operation settings, or by effecting settings for the punching process at the time of printing.

Tab sheets, however, are classified into already punched tab sheets and to-be-punched tab sheets.

In the prior art, the setting of the punching process for tab sheets is one of the following: the user sets the punching process every time immediately before the printing; the punching process is always performed based on fixed settings; or the initial system settings are changed according to the attributes of tab sheets.

Thus, the user has to perform printing by always paying attention to the punching process for tab sheets. Each time the user uses tab sheets which requires a different punching process than the already set one, time-consuming settings have to be performed once again, and the operability for the user deteriorates.

BRIEF SUMMARY OF THE INVENTION

The object of the present invention is to provide an image forming apparatus and an image forming method capable of reducing the load on the user in setting a tab sheet punching process and enhancing the operability in the setting.

In order to achieve the object, there is provided an image forming apparatus which has a plurality of sheet feed sections for feeding paper sheets, and forms an image on a paper sheet fed from any one of the sheet feed sections, the apparatus comprising: a punching process section which form punch holes in the paper sheet on which the image has been formed; a first setting section which sets the kind of paper sheets stored in each of the sheet feed sections; a second setting section which sets the presence/absence of a punching process of forming punch holes in the paper sheet fed from the sheet feed section, when the kind of paper sheets has been set by the first setting section; a storage section which stores information on the kind of paper sheets stored in the sheet feed section, which has been set by the first setting section, and presence/absence information of the punching process associated with the sheet feed section, which has been set by the second setting section; a designation section which designates the kind of paper sheets, or sheet feeding from any one of the sheet feed sections; and a control section which controls, when start of image formation has been instructed, the punching process section in accordance with the presence/absence information of the punching process stored in the storage section in association with the sheet feed section that stores the paper sheet of the kind designated by the designation section, or the sheet feed section that has been designated by the designation section.

There is also provided an image forming method for an image forming apparatus which has a plurality of sheet feed sections for feeding paper sheets, and forms an image on a paper sheet fed from any one of the sheet feed sections, the method comprising: setting, in initial operational settings of the image forming apparatus, the presence/absence of a first tab sheet punching process of forming punch holes in a tab sheet fed from the sheet feed section; setting the kind of paper sheets stored in each of the sheet feed sections, and setting the presence/absence of a second punching process of forming punch holes in the paper sheet fed from the sheet feed section; setting the presence/absence of a third tab sheet punching process of forming punch holes in the tab sheet, when the tab sheet is fed from any one of the sheet feed sections for formation of an image thereon; storing the set presence/absence information of the first tab sheet punching process, the set presence/absence information of the second punching process associated with the sheet feed section, and the set presence/absence information of the third tab sheet punching process; effecting a control, when start of image formation has been instructed to feed a tab sheet from one of the sheet feed sections and to form an image on the tab sheet, to execute the process to form punch holes when the stored presence/absence information of the third tab sheet punching process is "tab sheet punching process is present", and to prohibit the formation of punch holes when the stored presence/absence information of the third tab sheet punching process is "tab sheet punching process is absent"; effecting a control, when the presence/absence information of the third tab sheet punching process is "tab sheet punching process is absent", to form punch holes when the stored presence/absence information of the second punching process is "punching process is present", and to prohibit the formation of punch holes when the stored presence/absence information of the second punching process is "punching process is absent"; and effecting a control, when the presence/absence information of the second punching process is "punching process is absent," to form punch holes when the stored presence/absence information of the first tab sheet punching process is "tab sheet punching process is present", and to prohibit the formation of punch holes when the stored presence/absence information of the first tab sheet punching process is "tab sheet punching process is absent".

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
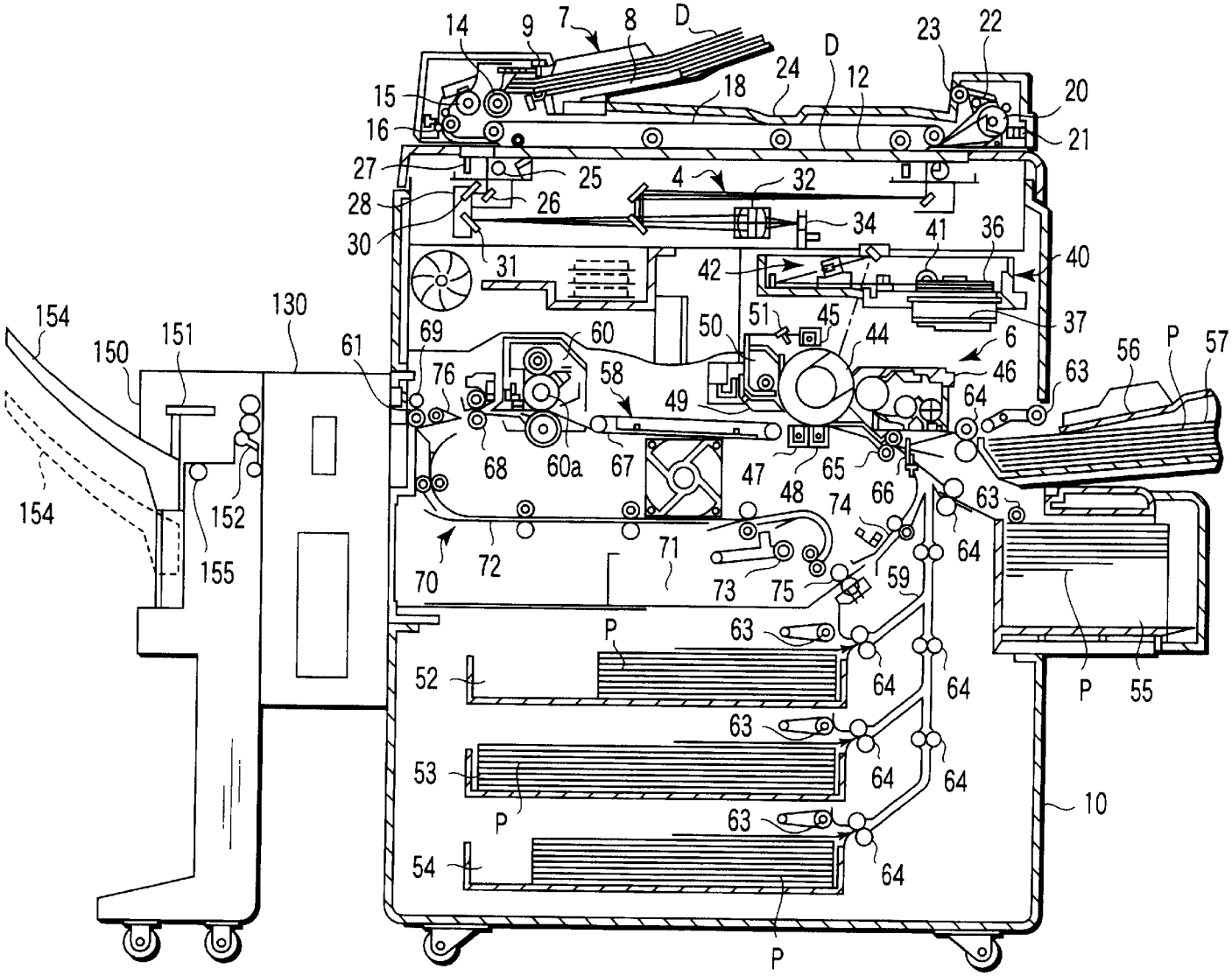
FIG. 1 is a cross-sectional view showing an internal structure of a digital copying machine according to the image forming apparatus of the present invention.

FIG. 1 is a cross-sectional view showing an internal structure of a digital copying machine (DPPC) according to an image forming apparatus of the present invention.

As is shown in FIG. 1, the digital copying machine has an apparatus main body 10. The apparatus main body incorporates a scanner section 4 functioning as an image read section and a printer section 6 functioning as an image forming section.

An original table 12 formed of transparent glass, on which a read object, i.e. an original D is placed, is disposed on the upper surface of the apparatus main body 10. An automatic document feeder 7 (hereinafter referred to as "ADF") for automatically feeding originals D onto the original table 12 is disposed on the upper surface of the apparatus main body 10. The ADF 7 is disposed to be opened/closed with respect to the original table 12 and serves as an original cover for bringing the original D placed on the original table 12 into close contact with the original table 12.

The ADF 7 has an original tray 8 on which the original D is set; pickup rollers 14 for picking up originals on the original tray 8 one by one; a feed roller 15 for conveying the picked-up original; an aligning roller pair 16 for aligning the leading edges of the originals; and a conveyor belt 18 disposed to cover almost the entire surface of the original table 12. A plurality of originals set on the original tray 8 with their surfaces facing up are sequentially taken out from the lowermost page, i.e. the last page, aligned by the aligning roller pair 16, and conveyed to a predetermined position on the original table 12 by the conveyor belt 18.

In the ADF 7, a reversing roller 20, a non-reverse sensor 21, a flapper 22 and a delivery roller 23 are disposed at the end portion on the opposite side of the aligning roller pair 16 with respect to the conveyor belt 18. The original D whose image information has been read by a scanner section 4 (to be described later) is fed from the original table 12 by the conveyor belt 18 and delivered to an original delivery section 24 on the ADF 7 through the reversing roller 20, flapper 21 and delivery roller 22. To read the lower surface of the original D, the flapper 22 is switched. The original D conveyed by the conveyor belt 18 is reversed by the reversing roller 20 and fed to a predetermined position on the original table 12 again by the conveyor belt 18.

The scanner section 4 provided in the apparatus main body 10 has an exposure lamp 25 as a light source for illuminating the original D placed on the original table 12, and a first mirror 26 for deflecting reflection light from the original D in a predetermined direction. The exposure lamp 25 and first mirror 26 are attached to a first carriage 27 disposed under the original table 12.

The first carriage 27 is disposed to be movable in parallel to the original table 12 and reciprocally moved under the original table 12 by a scanning motor through a toothed belt (not shown), etc.

A second carriage 28 movable in parallel to the original table 12 is disposed under the original table 12. Second and third mirrors 30 and 31 for successively deflecting reflection light from the original D, which has been deflected by the first mirror 26, are attached to the second carriage 28 at right angles with each other. The second carriage 28 is moved by, e.g. the toothed belt for driving the first carriage 27 along with the first carriage 27, and moved in parallel along the original table 12 at half the speed of the first carriage 27.

A focusing lens 32 for focusing reflection light from the third mirror 31 mounted on the second carriage 28, and a CCD (photoelectric conversion element) 34 for receiving the reflected light focused by the focusing lens and photoelectrically converting it are also disposed under the original table 12. The focusing lens 32 is disposed in a plane including the optical axis of the light deflected by the third mirror 31 so as to be movable by means of a driving mechanism. The focusing lens 32 moves to focus the reflection light at a desired magnification. The CCD 34 photoelectrically converts the incoming reflection light and outputs an electrical signal corresponding to the read original D.

On the other hand, the printer section 6 has a laser exposure unit 40 functioning as a latent image forming means. The laser exposure unit 40 comprises a semiconductor laser 41 as a light source; a polygon mirror 36 as a scanning member for continuously deflecting a laser beam emitted by the semiconductor laser 41; a polygon motor 37 as a scanning motor for rotatably driving the polygon mirror 36 at a predetermined rotational speed; and an optical system 42 for deflecting the laser beam from the polygon mirror 36 and guiding the beam to a photosensitive drum 44 (to be described later). The laser exposure unit 40 with the above structure is fixed to a support frame (not shown) of the apparatus main body 10.

The semiconductor laser 41 is ON/OFF-controlled in accordance with the image information of the original D read by the scanner section 4 or facsimile transmission/reception document information. The laser beam is directed to the photosensitive drum 44 through the polygon mirror 36 and optical system 42 to scan the outer surface of the photosensitive drum 44, thereby forming an electrostatic latent image on the outer peripheral surface of the photosensitive drum 44.

The printer section 6 has the rotatable photosensitive drum 44 as an image carrier disposed almost at the center of the apparatus main body 10. The outer peripheral surface of the photosensitive drum 44 is exposed to the laser beam from the laser exposure unit 40, and so a desired electrostatic latent image is formed thereon. Around the photosensitive drum 44, the following elements are arranged in the named order: a charger 45 for electrifying the outer peripheral surface of the drum 44 with a predetermined charge; a developing device 46 for supplying toner as a developer to the electrostatic latent image formed on the outer peripheral surface of the photosensitive drum 44 to develop it at a desired image density; a transfer charger 48, which integrally includes a separation charger 47 for separating an image formation medium, i.e. a paper sheet P, fed from a paper cassette (to be described later) from the photosensitive drum 44, and transfers the toner image formed on the photosensitive drum 44 onto the paper sheet P; a separation gripper 49 for separating the paper sheet P from the outer peripheral surface of the photosensitive drum 44; a cleaning unit 50 for removing toner remaining on the outer peripheral surface of the photosensitive drum 44; and a charge erase device 51 for erasing charge on the outer peripheral surface of the photosensitive drum 44.

An upper sheet cassette 52, a middle sheet cassette 53 and a lower sheet cassette 54 which can be drawn out of the apparatus main body 10 are stacked at the lower portion of the apparatus main body 10. These cassettes 52 to 54 store paper sheets P of different sizes. A large-capacity feeder 55 is disposed on one side of these cassettes. This large-capacity feeder 55 stores about 3000 paper sheets P having a size with high use frequency, e.g. paper sheets P with A4 size. A feed cassette 57 also serving as a manual feed tray 56 is detachably attached above the large-capacity feeder 55.

A convey path 58 extending from the sheet cassettes and large-capacity feeder 55 through a transfer section located between the photosensitive drum 44 and transfer charger 48 is formed in the apparatus main body 10. A fixing unit 60 having a fixing lamp 60*a* is disposed at the end of the convey path 58.

A delivery port 61 is formed in the side wall of the apparatus main body 10, which is opposed to the fixing unit 60.

A hole punch unit 13 is fitted in the delivery port 61.

The hole punch unit 13 is provided with a single-tray finisher 150.

Pickup rollers 63 for taking out the paper sheets P one by one from the sheet cassette 52, 53, 54, 57 or large-capacity feeder 55 are arranged near each of the upper sheet cassette 52, middle sheet cassette 53, lower sheet cassette 54 and feed cassette 57 and near the large-capacity feeder 55. A number of feed roller pairs 64 for conveying the paper sheet P taken out by the pickup rollers 63 through the convey path 58 are arranged in the convey path 58.

A registration roller pair 65 is arranged in the convey path 58 on the upstream side of the photosensitive drum 44. The registration roller pair 65 corrects a tilt of the extracted paper sheet P, registers the leading edge of the toner image on the photosensitive drum 44 and the leading edge of the paper sheet P, and feeds the paper sheet P to the transfer section at the same speed as the speed of movement of the outer peripheral surface of the photosensitive drum 44. A pre-aligning sensor 66 for detecting arrival of the paper sheet P is provided in front of the registration roller pair 65, i.e. on the feed roller 64 side.

Each paper sheet P extracted one by one from the sheet cassette, 52, 53, 54, 57 or large-capacity feeder 55 by the pickup rollers 63 is fed to the registration roller pair 65 by the feed roller pair 64. After the leading edge of the paper sheet P is aligned by the registration roller pair 65, the paper sheet P is fed to the transfer section.

In the transfer section, a developer image, i.e. toner image formed on the photosensitive drum 44 is transferred onto the paper sheet P by the transfer charger 48. The paper sheet P on which the toner image has been transferred is separated from the outer peripheral surface of the photosensitive drum 44 by the function of the separation charger 47 and separation gripper 49 and conveyed to the fixing unit 60 through a conveyor belt 67 constituting part of the convey path 58. After the developer image is melted and fixed on the paper sheet P by the fixing unit 60, the copying paper sheet P is delivered onto the finisher 150 through the delivery port 61 by a feed roller pair 68 and a delivery roller pair 69.

An automatic double-side unit 70 for reversing the paper sheet P which has passed through the fixing unit 60 and feeding it to the registration roller pair 65 again is provided under the convey path 58. The automatic double-side unit 70 comprises a temporary stack 71 for temporarily stacking the paper sheets P; a reversing path 72 branched from the convey path 58 to reverse the paper sheet P which has passed through the fixing unit 60 and to guide the paper sheet P to the temporary stack 71; pickup rollers 73 for extracting the paper sheets P stacked on the temporary stack one by one; and a feed roller 75 for feeding the extracted paper sheet P to the registration roller pair 65 through a convey path 74. A selector gate 76 for selectively distributing the paper sheets P to the delivery port 61 or reversing path 72 is provided at the branch portion between the convey path 58 and reversing path 72.

Where double-copying is performed, the paper sheet P which has passed through the fixing unit 60 is guided to the reversing path 72 by the selector gate 76, temporarily stacked on the temporary stack 71 in a reversed state, and fed to the registration roller pair 65 through the convey path 74 by the pickup rollers 73 and feed roller 75. The paper sheet P is registered by the registration roller pair 65 and fed to the transfer section again to transfer a toner image onto the reverse surface of the paper sheet P. Thereafter, the paper sheet P is delivered to the finisher 150 through the convey path 58, fixing unit 60 and delivery rollers 69.

The finisher 150 staples delivered copies of documents and stores them in units of a copy. Each time a paper sheet P to be stapled has been delivered from the delivery port 61, the paper sheet P passes through the hole punch unit 130 and aligned by a guide bar 151 to the stapling side. When all paper sheets have been delivered, a copy of paper sheets P is pressed by a paper press arm 152 and stapled by a stapler unit (not shown). Then the guide bar 151 moves downward. The stapled paper sheets P are delivered to a finisher delivery tray 154 by a finisher delivery roller 155 in units of a copy. The downward movement amount of the finisher delivery tray 154 is roughly determined in accordance with the number of paper sheets P to be delivered, and the finisher delivery tray 154 moves downward stepwise every time one copy is delivered. The guide bar 151 for aligning the delivered paper sheets P is located at such a high position that the guide bar 151 may not abut upon the already stapled paper sheets P placed on the finisher delivery tray 154.

The finisher delivery tray 154 is connected to a shift mechanism (not shown) which shifts (e.g. in four directions: front, rear, left and right sides) in units of a copy in the sort mode.

An operation panel 80 for inputting various copy conditions, a copy start signal for starting copying operations, etc. is provided at the upper portion on the front side of the apparatus main body 10.

Figure 2:
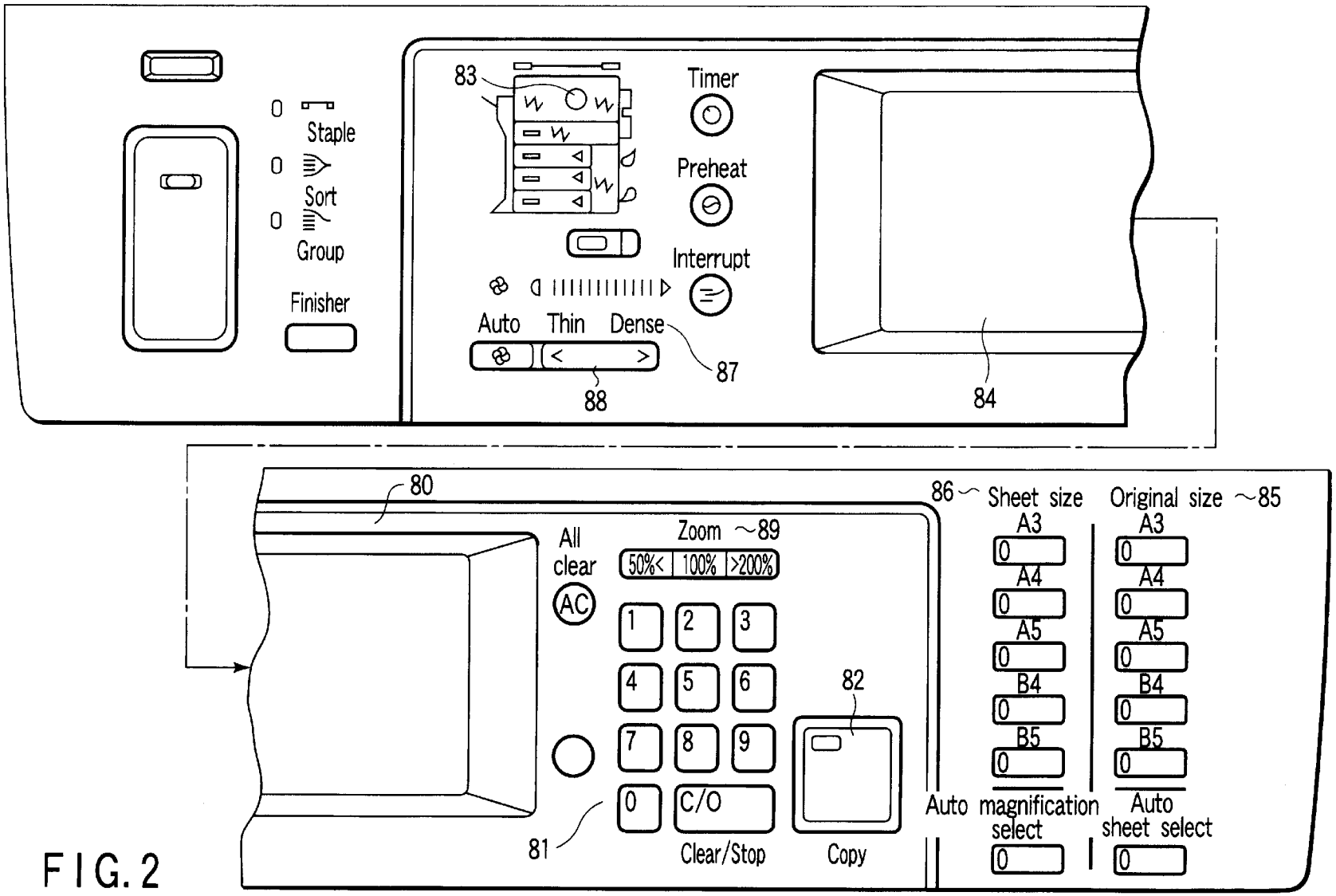
FIG. 2 is a plan view showing the structure of an operation panel.

As is shown in FIG. 2, the operation panel 80 comprises numeral keys 81, a copy key 82, a state display section 83, a liquid crystal display section 84, an original key size setting key 85, a sheet size setting key 86, a density display section 87, a density setting key 88, and a magnification setting key 89.

The numeral keys 81 are used to set the number of originals, or the number of copies.

The copy key 82 is used to instruct the start of copying.

The state display section 83 displays guidance on the state of selection of the sheet feed cassette, jamming of an original or a paper sheet, etc.

The liquid crystal display section 84 displays the number of originals and the number of copies, and also displays the copying magnification, editing, and various operational guidances. The liquid crystal display section 84 is provided with a touch panel, which enables input of various operational instructions, such as input by selection keys. For example, it displays selection keys for a photomode, a character mode and a character/photo mode as original modes, and permits input thereof.

The original size setting key 85 is used to set the size of the original D.

The sheet size setting key 86 is used to set the size of the sheet P.

The density display section 87 displays the copy density set by the density setting key 88.

Figure 3:
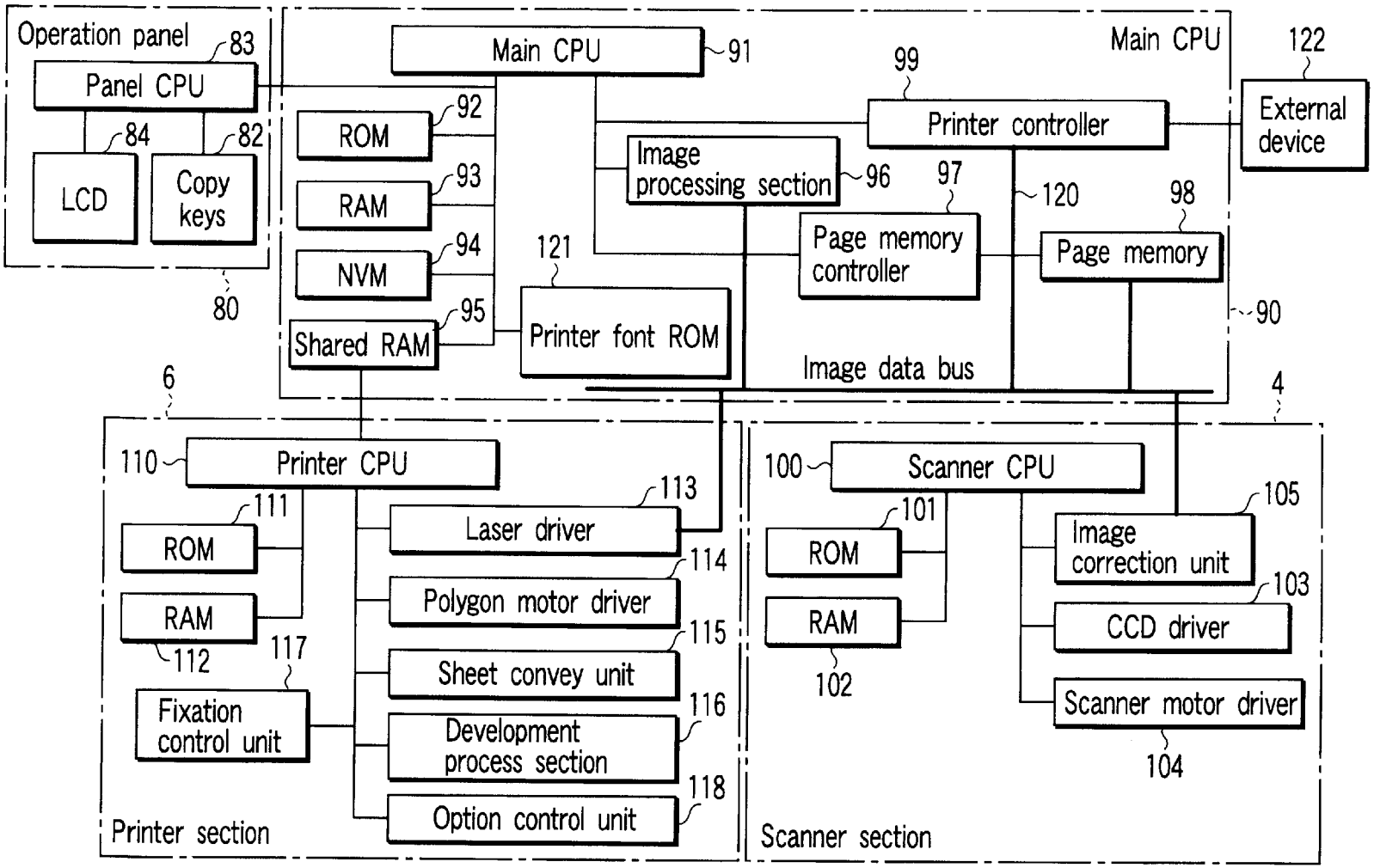
FIG. 3 is a block diagram schematically showing the structure of the digital copying machine.

FIG. 3 is a block diagram schematically showing electrical connection of the digital copying machine shown in FIG. 1 and flow of signals for control. In FIG. 3, in the digital copying machine, a control system comprises three CPUs: a main CPU 91 provided in a main control section 90; a scanner CPU 100 in the scanner section 4; and a printer CPU 110 in the printer section 6. The main CPU 91 performs bi-directional communication with the printer CPU 110 via a shared RAM 95. The main CPU 91 issues an operational instruction, and the printer CPU 110 returns status data. Serial communication is performed between the printer CPU 110 and scanner CPU 100. The printer CPU 110 issues an operational instruction, and the scanner CPU 100 returns status data.

The operation panel 80 is connected to the main CPU 91.

The main control section 90 comprises the main CPU 91, a ROM 92, a RAM 93, an NVRAM 94, a shared RAM 95, an image processing section 96, a page memory control unit 97, a page memory 98, a printer controller 99, and a printer font ROM 121.

The main CPU 91 controls the entirety of the main control section 90. The ROM 92 stores control programs, etc. The RAM 93 temporarily stores various data.

The NVM (Non-Volatile RAM) 94 is a non-volatile memory backed up by a battery (not shown). Even when power is not supplied to the NVM 94, stored data is maintained.

The shared RAM 95 is used to perform bidirectional communication between the main CPU 91 and printer CPU 110.

The page memory controller 97 stores and reads out image information in and from the page memory 98. The page memory 98 has areas capable of storing image information of a plurality of pages. The page memory 98 can store compressed data in units of a page, which is obtained by compressing image information from the scanner section 4.

A compression section 87 for compressing image data is connected to the page memory controller 97.

The printer font ROM 121 stores font data corresponding to print data.

The printer controller 99 develops print data, which is sent from an external device 122 such as a personal computer, into image data using the font data stored in the printer font ROM 121 with a resolution corresponding to resolution data added to the print data.

The scanner section 4 comprises the scanner CPU 100 for controlling the entirety of the scanner section 4; a ROM 101 storing control programs, etc.; a data storage RAM 102; a CCD driver 103 for driving the CCD sensor 34; a scan motor driver 104 for controlling the rotation of a scan motor for moving the exposure lamp 25, mirrors 26, 27 and 28, etc.; and an image correction unit 105. The image correction section 105 comprises an A/D converter for converting analog signals output from the CCD sensor 34 to digital signals; a shading correction circuit for correcting a variance in the CCD sensor 34, or a variation in threshold level due to ambient temperature variation relative to the output signal from the CCD sensor 34; and a line memory for temporarily storing shading-corrected digital signals from the shading correction circuit.

The printer section 6 comprises the printer CPU 110 for controlling the entirety of the printer section 6; a ROM 111 for storing control programs, etc.; a data storage RAM 112; a laser driver 113 for driving the semiconductor laser 41; a polygon motor driver (motor control unit) 114 for controlling the rotation of the polygon motor 37 of the laser exposure unit 40; a sheet convey unit 115 for controlling conveyance of the sheet P by the convey mechanism 58; a development process control section 116 for controlling charging, developing and transferring processes using the charging device 45, developing device 46 and transfer charger 48; a fixation control unit 17 for controlling the fixing device 60; and an option unit 118.

The image processing section 96, page memory 98, printer controller 99, image correction section 105, and laser driver 113 are connected over an image data bus 120.

The setting of the punching process for tab sheets according to the invention with the above structure will now be described.

(1) In this digital copying machine, the initial system operation is preset by a serviceman through the operation panel 80. In this case, setting is made as to whether the punching process should be performed when printing is effected on tab sheets. The setting of the presence/absence of the tab-sheet punching process is stored in the NVM 94 by the main CPU 91. Specifically, the NVM 94 stores a setting value indicating "tab-sheet punching process is present" when the punching process for tab sheets is to be performed, and a setting value indicating "tab-sheet punching process is absent" when the punching process for tab sheets is not to be performed.

(2) When tab sheets or paper sheets are placed in the upper sheet cassette 52, middle sheet cassette 53, lower sheet cassette 54, feed cassette 57 and large-capacity feeder 55, the user sets through the operation panel 80 the kind of sheets to be fed from each cassette (size, tab sheets or not) and the presence/absence of the punching process with respect to each cassette (or large-capacity feeder).

For example, when A3-size paper sheets are placed in the upper sheet cassette 52, B4-size paper sheets are placed in the middle sheet cassette 53, tab sheets are placed in the lower sheet cassette 54, B5-size paper sheets are placed in the feed cassette 57 and A4-size paper sheets are placed in the large-capacity feeder 55, the kinds of sheets in the respective cassettes are set. In addition, setting is effected as to whether the punching process should be performed for the sheets to be fed from each cassette.

The CPU 91 stores in the NVM 94 the setting results as to the kinds of sheets to be fed from each cassette, and the presence/absence of the punching process for the sheets. Specifically, the NVM 94 stores a setting value indicating "punching process is present" when the punching process is to be performed, and a setting value indicating "punching process is absent" when the punching process is not to be performed.

This setting has priority over the setting on the presence/absence of the tab-sheet punching by the serviceman, as described in the above procedure (1).

(3) When printing is effected on tab sheets by the present digital copying machine, the user can set the punching process for the tab sheets through the operation panel 80.

When the punching process has been set, the main CPU 91 determines "the punching process is present" and stores the setting value indicating this mode into the NVM 94. The main CPU 91 executes this setting for only one job to be executed immediately thereafter.

This setting has priority over the setting on the presence/absence of the punching process by the user, as described in the above procedure (2).

Figure 4:
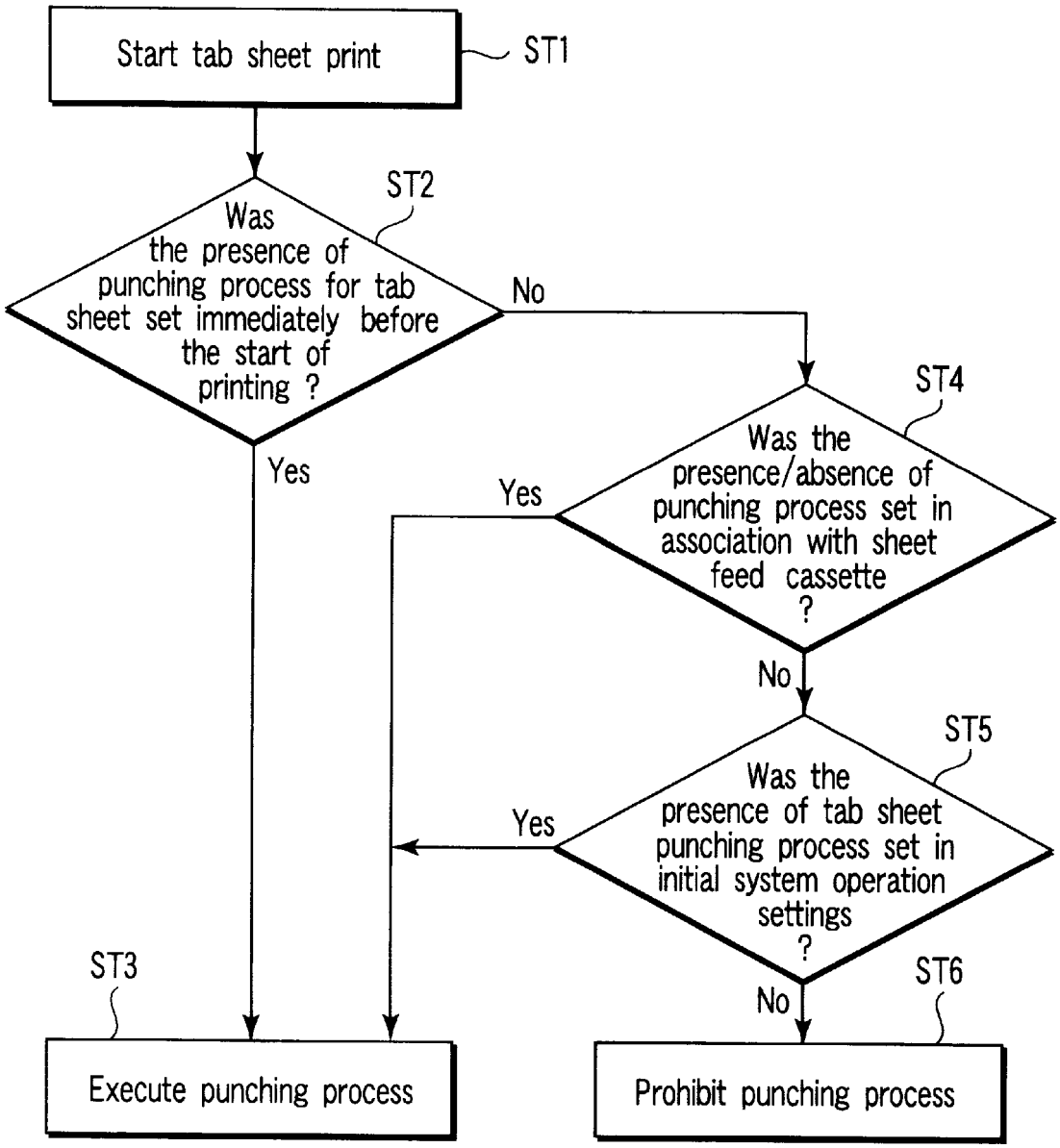
FIG. 4 is a flow chart illustrating a punching process operation for tab sheets.

The punching process operation for tab sheets will now be described with reference to a flow chart of FIG. 4.

When the copy key 82 has been depressed to start the printing on tab sheets (ST1), the main CPU 91 refers to the setting data on the presence/absence of the punching process stored in the NVM 94, and confirms whether the presence of the tab-sheet punching process has been set immediately before the start of printing (ST2).

If the presence of the tab-sheet punching process has been set immediately before the start of printing, the main CPU 91 enables the hole punch unit 130 to execute the punching process for the present job (ST3).

If the presence of the tab-sheet punching process has not been set immediately before the start of printing in step ST2, the main CPU 91 refers to the NVM 94 to confirm the setting on the presence/absence of the punching process in association with the sheet feed cassettes (including the large-capacity feeder) for feeding tab sheets (ST4).

If the presence of the punching process has been set in association with the sheet feed cassettes for feeding sheets, the main CPU 91 enables the hole punch unit 130 to perform the punching process (ST3).

If it is determined in step ST4 that the absence of the punching process has been set in association with the sheet feed cassettes for feeding sheets, the main CPU 91 refers to the NVM 94 to confirm whether the "tab-sheet punching process is present" was set in the initial system operation (ST5).

If the "tab-sheet punching process is present" was set, the main CPU 91 enables the hole punch unit 130 to perform the punching process (ST3).

If it is determined that the "tab-sheet punching process is present" was set, the punching process is not performed (ST6).

In the above-described embodiment, only tab sheets have been mentioned. Additionally, other kinds of sheets, e.g. A4-size sheets, may be punched by the same setting as with the tab sheets.

According to the above-described embodiment of the invention, when sheets are set in the feed cassettes, the presence/absence of the punching process is set in association with the feed cassettes. Thereby, the punching process can be set in connection with each of the individual cassettes. Accordingly, useless operations due to the erroneous setting of the punching process can be reduced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus which has a plurality of sheet feed sections for feeding paper sheets, and forms an image on a paper sheet fed from any one of the sheet feed sections, the apparatus comprising:

a punching process section which form punch holes in the paper sheet on which the image has been formed;

a first setting section which sets the kind of paper sheets stored in each of the sheet feed sections;

a second setting section which sets the presence/absence of a punching process of forming punch holes in the paper sheet fed from the sheet feed section, when the kind of paper sheets has been set by the first setting section;

a storage section which stores information on the kind of paper sheets stored in the sheet feed section, which has been set by the first setting section, and presence/absence information of the punching process associated with the sheet feed section, which has been set by the second setting section;

a designation section which designates the kind of paper sheets, or sheet feeding from any one of the sheet feed sections; and a control section which controls, when start of image formation has been instructed, the punching process section in accordance with the presence/absence information of the punching process stored in the storage section in association with the sheet feed section that stores the paper sheet of the kind designated by the designation section, or the sheet feed section that has been designated by the designation section.

2. An image forming apparatus according to claim 1, wherein said punching process section is a hole punch unit that is detachably attached.

3. An image forming apparatus according to claim 1, wherein said first setting section sets the size of paper sheets stored in the sheet feed section, and also effects setting as to whether the paper sheets are tab sheets.

4. An image forming apparatus according to claim 1, wherein said second setting section sets the presence/absence of the punching process such that the second setting section sets information "punching process is present" when paper sheets fed from the sheet feed section are to be punched, and information "punching process is absent" when paper sheets fed from the sheet feed section are not to be punched.

5. An image forming apparatus according to claim 1, wherein said storage section is a non-volatile RAM backed up by a battery.

6. An image forming apparatus according to claim 1, wherein at the time of designating the kind of paper sheets, said designation section designates the size of paper sheets or designates whether paper sheets are tab sheets.

7. An image forming apparatus according to claim 1, wherein said control section causes the punching process section to form punch holes when the presence/absence information of the punching process stored in the storage section is "punching process is present", and prohibits the punching process section from forming punch holes when the presence/absence information of the punching process stored in the storage section is "punching process is absent."

8. An image forming apparatus which has a plurality of sheet feed sections for feeding paper sheets, and forms an image on a paper sheet fed from any one of the sheet feed sections, the apparatus comprising:

a punching process section which form punch holes in the paper sheet on which the image has been formed;

a first setting section which sets, in initial operational settings of the image forming apparatus, the presence/absence of a tab sheet punching process of forming punch holes in a tab sheet fed from the sheet feed section;

a second setting section which sets the kind of paper sheets stored in each of the sheet feed sections, and sets the presence/absence of a punching process of forming punch holes in the paper sheet fed from the sheet feed section;

a third setting section which sets the presence/absence of the tab sheet punching process of forming punch holes in the tab sheet, when the tab sheet is fed from any one of the sheet feed sections for formation of an image thereon;

a storage section which stores the presence/absence information of the tab sheet punching process set by the first setting section, the presence/absence information of the punching process associated with the sheet feed section, which has been set by the second setting section, and the presence/absence information of the tab sheet punching process set by the third punching section;

a first control section which effects a control, when start of image formation has been instructed to feed a tab sheet from one of the sheet feed sections and to form an image on the tab sheet, to cause the punching process section to form punch holes when the presence/absence information of the tab sheet punching process set by the third setting section and stored in the storage section is "tab sheet punching process is present", and to prohibit the punching process section from forming punch holes when the presence/absence information of the tab sheet punching process set by the third setting section and stored in the storage section is "tab sheet punching process is absent";

a second control section which executes a control, when the first control section executes the control to prohibit formation of punch holes, to cause the punching process section to form punch holes when the presence/absence information of the punching process set by the second setting section and stored in the storage section is "punching process is present", and to prohibit the punching process section from forming punch holes when the presence/absence information of the punching process set by the second setting section and stored in the storage section is "punching process is absent"; and a third control section which executes a control, when the second control section executes the control to prohibit formation of punch holes, to cause the punching process section to form punch holes when the presence/absence information of the tab sheet punching process set by the third setting section and stored in the storage section is "tab sheet punching process is present", and to prohibit the punching process section from forming punch holes when the presence/absence information of the tab sheet punching process set by the third setting section and stored in the storage section is "tab sheet punching process is absent".

9. An image forming method for an image forming apparatus which has a plurality of sheet feed sections for feeding paper sheets, and forms an image on a paper sheet fed from any one of the sheet feed sections, the method comprising:

setting, in initial operational settings of the image forming apparatus, the presence/absence of a first tab sheet punching process of forming punch holes in a tab sheet fed from the sheet feed section;

setting the kind of paper sheets stored in each of the sheet feed sections, and setting the presence/absence of a second punching process of forming punch holes in the paper sheet fed from the sheet feed section;

setting the presence/absence of a third tab sheet punching process of forming punch holes in the tab sheet, when the tab sheet is fed from any one of the sheet feed sections for formation of an image thereon;

storing said set presence/absence information of the first tab sheet punching process, said set presence/absence information of the second punching process associated with the sheet feed section, and said set presence/absence information of the third tab sheet punching process;

effecting a control, when start of image formation has been instructed to feed a tab sheet from one of the sheet feed sections and to form an image on the tab sheet, to execute the process to form punch holes when said stored presence/absence information of the third tab sheet punching process is "tab sheet punching process is present", and to prohibit the formation of punch holes when said stored presence/absence information of the third tab sheet punching process is "tab sheet punching process is absent";

effecting a control, when the presence/absence information of the third tab sheet punching process is "tab sheet punching process is absent", to form punch holes when said stored presence/absence information of the second punching process is "punching process is present", and to prohibit the formation of punch holes when said stored presence/absence information of the second punching process is "punching process is absent"; and effecting a control, when said presence/absence information of the second punching process is "punching process is absent," to form punch holes when said stored presence/absence information of the first tab sheet punching process is "tab sheet punching process is present", and to prohibit the formation of punch holes when said stored presence/absence information of the first tab sheet punching process is "tab sheet punching process is absent".

* * * * *